US006473108B1

(12) United States Patent
Chassende-Baroz et al.

(10) Patent No.: US 6,473,108 B1
(45) Date of Patent: Oct. 29, 2002

(54) HEAT PRINTING DEVICE

(75) Inventors: Eric Chassende-Baroz, Courcouronnes (FR); Olivier Gery, Puiseaux (FR); Laurent Coldre, Puiseaux (FR)

(73) Assignee: Axiohm, Montrouge (FR)

( * ) Notice: Subject to any disclaimer, the term of this patent is extended or adjusted under 35 U.S.C. 154(b) by 0 days.

(21) Appl. No.: 09/646,586

(22) PCT Filed: Mar. 15, 1999

(86) PCT No.: PCT/FR99/00569

§ 371 (c)(1),
(2), (4) Date: Jun. 20, 2001

(87) PCT Pub. No.: WO99/47358

PCT Pub. Date: Sep. 23, 1999

(30) Foreign Application Priority Data

Mar. 19, 1998 (FR) ..... 98 03366

(51) Int. Cl.[7] ..... B41J 2/335; B41J 2/345
(52) U.S. Cl. ..... 347/208
(58) Field of Search ..... 347/200, 208

(56) References Cited

U.S. PATENT DOCUMENTS

| | | | |
|---|---|---|---|
| 5,309,181 A | 5/1994 | Ota et al. | |
| 5,353,046 A | 10/1994 | Tanaka et al. | |
| 5,680,170 A | 10/1997 | Takakura et al. | |

FOREIGN PATENT DOCUMENTS

| | | | |
|---|---|---|---|
| DE | 3702849 | 8/1988 | |
| EP | 0513660 | 11/1992 | |
| FR | 2730667 | 8/1996 | |
| JP | 60-6480 | * 1/1985 | ..... 347/208 |

OTHER PUBLICATIONS

Patents Abstracts of Japan vol. 015, No. 381 (M–1162) Sep. 26, 1991 & JP 03 153363A (Seiko Epson Corp) Jul. 01, 1991.

Patent Abstracts of Japan vol. 012, No. 081 (M–676) Mar. 15, 1988 & JP 62 221550 A (Konishiroku Photo Ind Co LTD) Sep. 29, 1987.

* cited by examiner

*Primary Examiner*—Huan Tran
(74) *Attorney, Agent, or Firm*—George R. McGuire Hancock & Estabrook, LLP

(57) ABSTRACT

A thermal print device comprising a plane support (1) of rectangular shape that is fitted on one of its faces, parallel to one of its longitudinally-extending edges (1*a*), with a resistive line (17) extending over conductor segments (14, 15) disposed perpendicularly thereto and extending alternately to one side and to the other side of the resistive line (17), one (14) of the series of segments coming from a common conductor which is constituted by a conductive layer covering the support, and in which the resistive line (17) and the conductor segments (14, 15) across which it extends are formed on an insulating layer (7) covering the conductive layer (3).

3 Claims, 1 Drawing Sheet

HEAT PRINTING DEVICE

CROSS-REFERENCE TO RELATED APPLICATION

The present application is the U.S. National Stage filing under 35 U.S.C. §371 of International Application No. PCT/FR99/00569, filed Mar. 15, 1999, and claims priority under 35 U.S.C. §§119 and 365 to French Application No. 98/03366, filed Mar. 19, 1998.

The prior international application was published on Sep. 23, 1999 as Publication No. WO 99/47358 in the French language.

BACKGROUND OF THE INVENTION

The present invention relates to a thermal print device or thermal printer head.

In general, such a device comprises a ceramic plate which constitutes the base support for all of the functional elements and circuitry that connects a line of heater points (a resistive line) to integrated circuits for controlling these points in response to signals received from an external processor.

The well-known principle on which a thermal print head is based lies in applying on/off control of an electric circuit which has a resistive line portion that heats up under the Joule effect when the circuit is powered and then radiates towards a temperature-sensitive medium that is close to said resistive line portion (practically in contact with the line, ignoring its protective coating) so that the color of the medium at the point of contact changes (e.g. going from white to black).

The resistive line extends across consecutive conductor segments. Every other segment is connected to a common conductor on one side of the line, while each of the intervening segments extends from the other side of the line and has electronic means for switching it on and off, which means are housed in an integrated circuit (known as a "driver") for controlling a plurality of conductors (e.g. sixty-four conductors). A heating point is thus activated by looping the common conductor and one of the above-mentioned intervening segments via a power supply. Electricity then flows through the portion of the resistive line which extends between two consecutive segments connected to the common conductor and extending across said conductor.

The resistive line is usually situated close to one of the longitudinal edges of the ceramic plate. The common conductor extends between this edge and the line. Furthermore, the connections between the print head and firstly the power supply and secondly the processor for controlling the drivers take place beside the longitudinally-extending edge of the plate which is opposite from its edge adjacent to the resistive line. It is therefore necessary to extend the common conductor as far as said edge, and in present print heads this extension takes place along one of the transversely-extending edges of the plate.

The cross-section of the common conductor and of its extension depends directly on the maximum quantity of electrical current they are to carry, and this can be large (several amps) if all of the heating points are activated. For given thickness of this common conductor, its cross-section depends on its width, and the portion of the common conductor which extends across the plate can be about one centimeter wide. This design is common to all print heads, and in particular to those used for printing travel tickets (over a print width lying in the range 60 mm to 120 mm), and it requires the plate to be longer than the print width (by about 8% to 15%). It will be understood that, by construction, the transverse size of the print head is longer than the length of the resistive line and thus longer than the width of the printing to be performed, and that this extra length can be unacceptable in certain applications. Since the present technological trend is towards miniaturizing equipment as much as possible, and in particular information processing equipment, there exists a need to reduce this size so that the transverse size of the thermal printing mechanism is as close as possible to the width of the medium (strip of paper) on which printing is to be performed.

SUMMARY OF THE INVENTION

An object of the present invention is to satisfy this need by providing a print head whose resistive line is of a length that is equal to the longitudinal size of the ceramic plate that forms the support of the head. The means of the invention which enable this object to be satisfied also make it possible to envisage a modular structure for print heads so that by juxtaposing modules in the resistive line direction, it is easy to obtain a range of printers of differing print widths.

To this end, the invention thus provides a thermal print device comprising a plane support of rectangular shape that is fitted on one of its faces, parallel to one of its longitudinally-extending edges, with a resistive line extending over conductor segments disposed perpendicularly thereto and extending alternately to one side and to the other side of the resistive line, one of the series of segments coming from a common conductor which is constituted by a conductive layer covering the support, while the resistive line and the conductor segments across which it extends are formed on an insulating layer that covers the conductive layer.

This particular disposition for the common conductor makes it possible to avoid reserving a special portion of the support and in particular a portion in the vicinity of one of its two transversely-extending ends for the purpose of passing the common conductor. As a result, the resistive line can extend longitudinally from one end of the support to the other, thus making it possible for the printing line to be as wide as the support, which means that thermal printer heads can be made of transverse size that can be kept down to a minimum.

Preferably, the insulating layer leaves an uncovered strip of the conducive layer adjacent to one of the edges of the support, forming the zone in which one of the series of conductor segments is provided and extending between said edge of the support and the resistive line, the conductive layer being cut out to form crennelations in the vicinity of the other longitudinally-extending edge of the support to form areas enabling it to be connected to a power supply, which areas are likewise left uncovered by the insulating layer.

The invention also provides a thermal print head comprising at least two modules, each constituted by a device as described above, said devices being juxtaposed and connected in such a manner that their resistive lines are in alignment with each other.

Other characteristics and advantages of the invention will appear on reading the following description of an embodiment given by way of example.

BRIEF DESCRIPTION OF THE DRAWINGS

Reference is made to the accompanying drawings in which.

DETAILED DESCRIPTION OF THE PREFERRED EMBODIMENT

Figure 1:
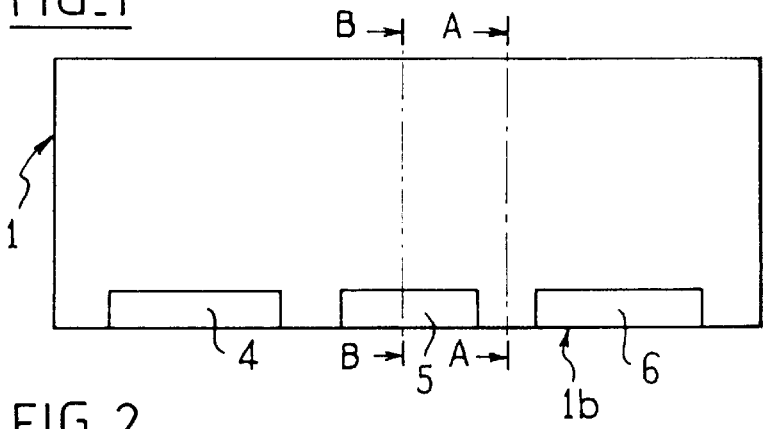
FIGS. 1 to 4 and the corresponding sections 1A to 4B show four essential steps in the method of manufacturing a thermal print device of the invention.
Figure 1A:
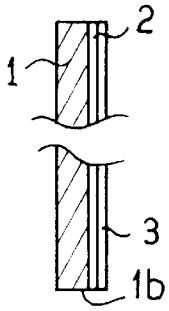
Figure 1B:
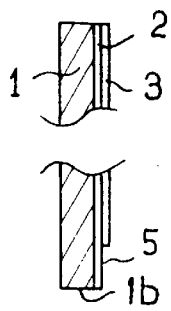

FIGS. 1, 1A, and 1B show a rectangular ceramic plate 1 covered in a first layer 2 made of glass, and covered over practically its entire surface area in a second layer 3 that is conductive, e.g. made of gold. The layer 3 covers practically the entire area of the ceramic plate with the exception of cutouts 4, 5, and 6 along one of the longitudinally-extending edges 1*b* of the plate, through which the glass layer 2 is left visible. The thin or thick layer coating techniques used for manufacturing a device of the invention are known in themselves and are not described in detail below.

Figure 2:
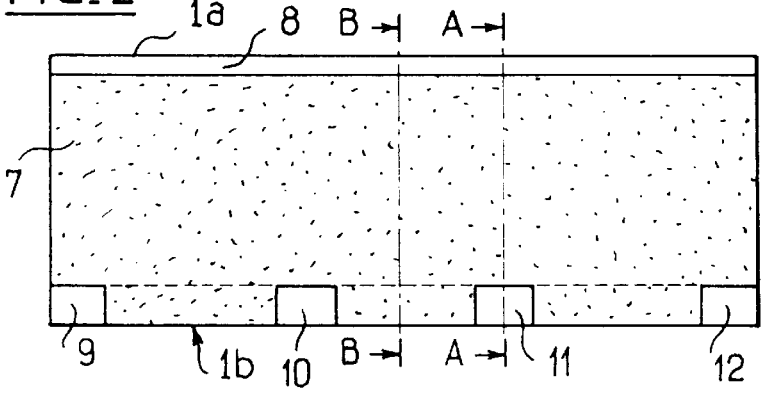
Figure 2A:
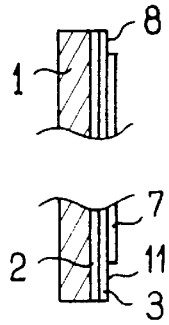
Figure 2B:
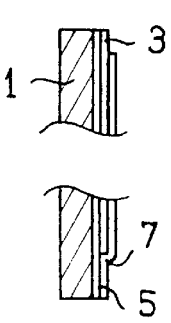

In FIGS. 2, 2A, and 2B, the FIG. 1 device has been fitted with an insulating layer 7 of a shape such as to leave a margin 8 uncovered in the vicinity of the longitudinally-extending edge 1*a* of the plate where the conductive layer 3 remains visible. Beside the edge 1*b*, the insulating layer 7 covers the setbacks 4, 5, and 6 previously provided in the conductive layer 3, but leaves zones 9, 10, 11, and 12 of said layer 3 uncovered to constitute connection areas for connecting the conductive layer to an electricity power supply.

Figure 3:
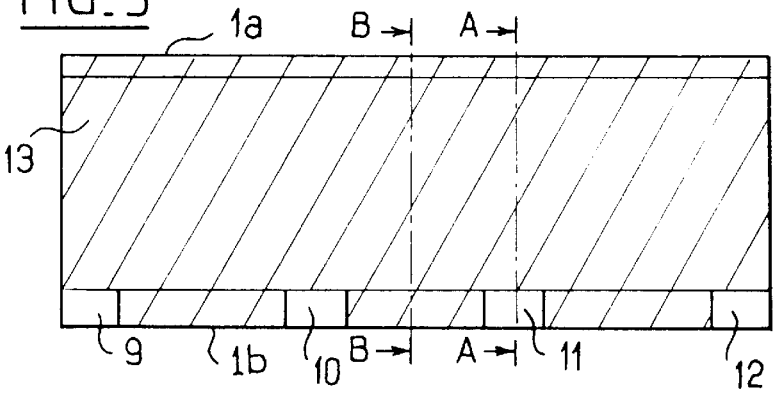
Figure 3A:
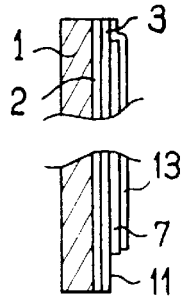
Figure 3B:
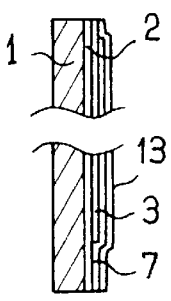

The third step in manufacturing the device of the invention consists in covering the insulating layer 7 and the margin 8 in two layers of gold, firstly a fine layer and then a thick layer, which layers are given a common reference 13 in FIGS. 3, 3A, and 3B. The areas 9, 10, 11, and 12 remain uncovered and insulated from the conductive layers 13 covering the insulating layer 7. Electrical continuity between the layer 13 and the conductive layer 3 is provided via the margin 8.

Figure 4:
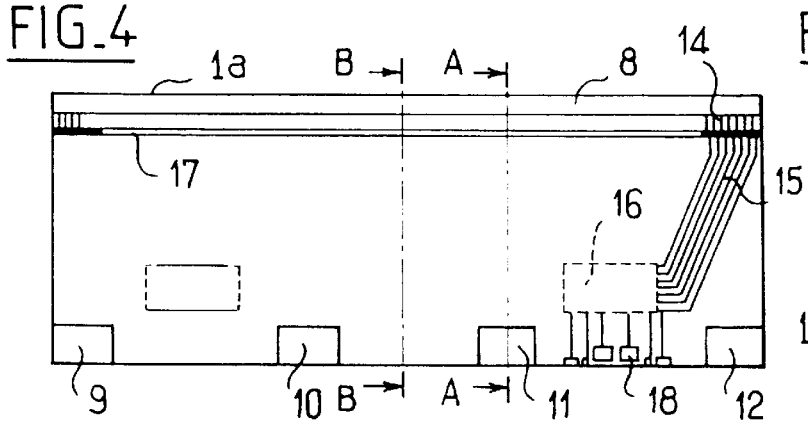
Figure 4A:
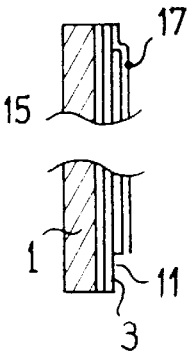
Figure 4B:
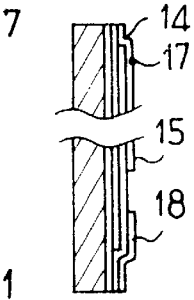

Thereafter, and as shown diagrammatically in FIGS. 4, 4A, and 4B, the layer 13 is etched in conventional manner to make the various conductive segments 14 which are electrically connected to the conductive layer 3 by the margin 8, and the conductive segments 15 which terminate in the locations 16 reserved for the integrated circuits that control and monitor the operation of the print head. A resistive line 17 is provided where the conductors 14 and 15 are adjacent and disposed between one another in conventional manner, this being done by depositing a suitable substance, the line 17 extending over the entire length of the plate 1 since it is possible for the conductive segments 14 and 15 to be provided over this length in full.

A protective layer of glass (not shown) then covers this surface in full. Naturally, prior to putting this protective layer (not shown) into place, conductors 18 are also etched in the vicinity of the edge 1*b* of the plate and between the above-mentioned areas 9, 10, 11, and 12, said conductors 18 serving to connect the circuits to the power supply and to the various control members or processors to which the print device is to be connected.

The advantages of such a structure are considerable. Firstly, the cross-section of the common power supply conductor is large since it is constituted by the cross-section of the conductive layer 3. In addition, the power supply current travelling in the common conductor is very well distributed within the conductive layer 3 regardless of the location of a heating point along the resistive line 17. Finally, this resistive line possesses heating points all the way to the transversely-extending ends of the support 1 of the print device.

This structure also has the advantage of enabling two or more supports of the kind shown in FIGS. 4, 4A, and 4B to be juxtaposed so as to be associated via their transversely-extending ends so as to build up a resistive line of greater length. These supports are easily held edge to edge so that the resistive line in one is in alignment with the resistive line of the next. Special machining of these transversely-extending edges and special control of the heating points which are adjacent thereto make it possible to obtain continuity of printing along the entire length of the resistive strip. The structure of the print device of the invention makes it possible to envisage modular construction of thermal print heads using a single manufacturing process, thus making it possible to provide different print widths by means of manufacturing tools that are rationalized and much less expensive than the production tools that have been used in the past which have necessarily been dedicated to each width or type of print head.

What is claimed is:

1. A thermal print device comprising a plane support (1) of rectangular shape that is fitted on one of its faces, parallel to one of its longitudinally-extending edges (1*a*), with a resistive line (17) extending over conductor segments (14, 15) disposed perpendicularly thereto and extending alternately to one side and to the other side of the resistive line (17), one (14) of the series of segments coming from a common conductor, the device being characterized in that the common conductor is constituted by a conductive layer covering the support, and in that the resistive line (17) and the conductor segments (14, 15) across which it extends are formed on an insulating layer (7) covering the conductive layer (3), the insulating layer (7) leaving an uncovered strip (8) of the conductive layer (3) adjacent to one of the edges (1*a*) of the support, forming the zone in which one of the series (14) of conductor segments is provided and extending between said edge (1*a*) of the support (1) and the resistive line (17), the conductive layers (3) being cut out to form crennelations in the vicinity of the other longitudinally-extending edge (1*b*) of the support to form areas (9, 10, 11, 12) enabling it to be connected to a power supply, which areas are likewise left uncovered by the insulating layer (7).

2. A thermal print device according to claim 1, characterized in that the resistive line (17) is of a length equal to the longitudinal dimension of the support (1).

3. A thermal print head, characterized in that it comprises at least two modules, each constituted by a device according to any one of claims 1 or 2, said devices being juxtaposed and connected in such a manner that their resistive lines (17) are in alignment with each other.

* * * * *